252/100 United States Patent [19]
Schindler et al.
[11] Patent Number: 4,704,212
[45] Date of Patent: Nov. 3, 1987

[54] COMPOSITION AND PROCESS FOR THE AFTERTREATMENT OF WASHED LAUNDRY

[75] Inventors: Norbert Schindler; Hans Nuesslein, both of Langenfeld; Edgar Koeppelmann, Hilden; Joerg Poethkow, Duesseldorf, all of Fed. Rep. of Germany

[73] Assignee: Henkel Kommanditgesellschaft auf Aktien, Duesseldorf, Fed. Rep. of Germany

[21] Appl. No.: 803,363

[22] Filed: Dec. 2, 1985

[30] Foreign Application Priority Data

Dec. 3, 1984 [DE] Fed. Rep. of Germany ..... 3444068

[51] Int. Cl.[4] ..... D06M 9/00

[52] U.S. Cl. ..... 252/8.8; 252/102; 252/136; 252/100; 252/142; 8/137

[58] Field of Search ..... 252/8.6, 8.8, 102, 142, 252/136, 100; 8/525, 137

[56] References Cited

U.S. PATENT DOCUMENTS

| | | | |
|---|---|---|---|
| 3,193,505 | 7/1965 | Blomfield et al. | 252/136 |
| 3,676,353 | 7/1972 | Ciko | 252/136 |
| 3,925,230 | 12/1975 | Koepfle et al. | 252/136 |
| 3,984,335 | 10/1976 | Ciko et al. | 252/8.6 |
| 4,053,423 | 10/1977 | Ciko et al. | 252/8.75 |
| 4,089,786 | 5/1978 | Ciko et al. | 252/8.8 |
| 4,115,281 | 9/1978 | Ciko et al. | 252/8.8 |

FOREIGN PATENT DOCUMENTS

| | | |
|---|---|---|
| 2904876 | 8/1980 | Fed. Rep. of Germany . |
| 3205317 | 8/1983 | Fed. Rep. of Germany . |

*Primary Examiner*—Josephine L. Barr
*Attorney, Agent, or Firm*—Ernest G. Szoke; Henry E. Millson, Jr.; Real J. Grandmaison

[57] ABSTRACT

Liquid aftertreatment preparations for laundry having fabric-softening, acidifying and antichlorinating properties which contain, in acidic aqueous solution, hydrogen peroxide or an organic percarboxylic acid, a quaternary ammonium compounds, and hexafluorosilicic acid and/or water-soluble salts thereof, more especially the magnesium salt, as an acidifying agent. Preparations containing magnesium salts of hexafluorosilicic acid are distinguished by particularly high stability of the per compounds.

20 Claims, No Drawings

COMPOSITION AND PROCESS FOR THE AFTERTREATMENT OF WASHED LAUNDRY

BACKROUND OF THE INVENTION

1. Field of the Invention

The present invention relates to a liquid preparation for the aftertreatment of washed laundry and to a process for its use.

2. Description of Related Art

Commercial laundries normally use detergents of very high alkali contents. Hypochlorite is generally used for bleaching. Detergent and bleach residues adhering to the washed laundry after the final rinse cannot be economically removed by rinsing alone. However, it is essential to remove such residues, for example to avoid skin irritation and to eliminate the unpleasant odor of chlorine emanating from the hypochlorite. In addition, residues of hypochlorite or chlorine damage the textile fibers.

For this reason, preparations containing acidic and/or reducing constituents are added before the final rinse to convert the troublesome detergent and bleach residues into harmless compounds. In many cases, it is also desirable for the washed laundry to have a pleasant, soft feel after drying. This applies in particular to laundry which comes in contact with the skin and to terry fabrics. In some cases, bacteriostatic finishing is also necessary, as for example in the case of roller towels.

For this reason, the final rinse is often followed by a treatment with a fabric softener and/or with antibacterial agents in aqueous solution, or during the subsequent drying process in an automatic dryer.

The treatment process generally involves the individual steps of "acidifying" (neutralizing) and "antichlorinating" (reducing) and of softening and antibacterial finishing. Accordingly, preparations and processes for acidifying and antichlorinating freshly washed laundry and also for aftertreatment with fabric softeners and antibacterial agents in a single step represent a considerable simplification of the aftertreatment process so far as commercial laundries are concerned. The preparations and processes known from U.S. Pat. Nos. 3,193,505; 3,676,353; 3,925,230; 3,984,335; 4,053,423; 4,089,786, 4,115,281 and from German Pat. Application P No. 29 04 876.8 do not satisfy or do not fully satisfy the need for equally good softening and antibacterial finishing, acidification and antichlorination in a single step; neither can the preparations be automatically dispensed without difficulty because they are used in powder form. The use of liquid aftertreatment preparations (which could be prepared for example by dissolving powders to form a stock solution), which is basically desirable by virtue of the dispensers for liquid preparations normally present in commercial washing machines, is generally prevented by the poor solubility or inadequate solution or dispersion stability of the known aftertreatment preparations designed for use in commercial laundries. Known liquid preparations do not show acidifying, antichlorinating and softening properties all at the same time.

German Application No. P 32 05 317.7 describes a liquid aftertreatement preparation for washing which combines softening, acidifying and antichlorinating properties. In addition to fabric-softening quaternary ammonium compounds, the fabric treatment preparations disclosed in the above German application contain hydrogen peroxide or organic percarboxylic acids as reducing agents for chlorine and chlorine compounds of positive valency and, in addition, stabilizers for the peroxy compounds, particularly the hydrogen peroxide. By adding acidifying agents, particularly phosphoric acid or acidic salts of phosphoric acid, and also inorganic and/or organic acids or salts, the pH-value of the preparation is reduced to such an extent that it is at most pH 4. In addition, the preparations according to the above German application may contain other standard additives, for example antibacterial agents. Examples of other additives are dispersants, foam regulators and also dyes and perfumes. The liquid carrier used is water, optionally with additions of organic water-miscible solvents.

DESCRIPTION OF THE INVENTION

Other than in the operating examples, or where otherwise indicated, all numbers expressing quantities of ingredients or reaction conditions used herein are to be understood as modified in all instances by the term "about".

An object of the present invention is further to improve the preparations described in German Application P No. 32 05 317.7. More particularly, the object of the invention is to improve the stability in storage and, hence, to prolong the shelf life of those preparations.

The mixtures described in the above German application contain per compounds, particularly hydrogen peroxide, as an essential constituent. With hydrogen peroxide, quaternary ammonium compounds and an acidifying agent, particularly phosphoric acid or phosphoric acid salts, it is possible to make up extremely stable solutions provided a complexing agent for heavy metal ions is also present. However, further investigations have now suprisingly shown that a further substantial improvement in the stability in storage and, hence, in the shelf life of preparations of the above type can be obtained by using specific acidiying agents.

In a first embodiment, therefore, the present invention relates to liquid aftertreatment preparations for laundry having fabric-softening, acidifying and antichlorinating properties and containing, in acidified aqueous solution, hydrogen peroxide or an organic percarboxylic acid, stabilizers for peroxy compounds, fabric-softening quaternary ammonium compounds and acidifying agents and, if desired, other standard additives. The new aftertreatment preparations according to the invention contain hexafluorosilicic acid and/or water-soluble salts thereof as an acidifying agent. The amount of hexafluorosilicic acid and/or water-soluble salts thereof in the aftertreatment preparation preferably amounts to between 1 and 25% by weight and, more particularly, to between 5 and 20% by weight. In one important embodiment of the invention, the hexafluorosilicic acid or its salts are the sole or predominant acidifying constituent of the aftertreatment preparation, it being preferred in this case, too, to adjust pH-values to no higher than 4 in the aqueous aftertreatment preparation. Suitable water-soluble salts of hexafluorosilicic acid are, for example, corresponding salts of the elements of the first to third group of the periodic system, the ammonium salt of hexafluorosilicic acid and the corresponding water-soluble amine and/or quaternary ammonium salt. The water-soluble amine salts are preferably monoalkyl or dialkyl amines in which the alkyl groups are $C_1$–$C_6$ straight or branched chain alkyl groups, such as methyl amine, ethyl amine, propyl amine, dimethyl amine, diethylamine, etc. The quaternary ammonium salts are preferably those formed from $C_1$–$C_6$ trialkylamines.

In addition to hexafluorosilicic acid, its sodium, potassium and/or ammonium salts, particularly suitable acidifying components can be the magnesium salt and/or the zinc salt, the magnesium salt being preferred by virtue of its outstanding acidifying and peroxide-stabilizing effect. Particularly suitable quantities of these acidifying agents are quantities of from 8 to 18% by weight.

Suitable fabric-softening components are quaternary ammonium compounds preferably containing two long-chain, preferably saturated aliphatic radicals each containing from 14 to 26 and preferably from 16 to 20 carbon atoms and at least one quaternary nitrogen atom in the molecule. The long-chain aliphatic radicals can be linear or branched and, accordingly, can originate from fatty acids or from fatty amines, Guerbet amines or from the alkyl amines obtainable by reduction of nitroparaffins. These quaternary ammonium compounds are, in particular, derivatives of ammonia, i.e. the quaternary salts obtainable by alkylation of long-chain secondary amines, such as for example the compounds distearyl dimethylammonium chloride and ditallow alkyldimethylammonium chloride, or the imidazoline compounds which can be obtained by reaction of 1 mole of an aminoalkyl ethylene diamine or hydroxyalkyl ethylene diamine with 2 moles of a long-chain $C_{12}$–$C_{26}$ fatty acid or an ester thereof and which are subsequently converted by alkylation into the quaternary imidazolinium compounds. In these quaternary ammonium compounds, the anion generally consists of the acid radical formed from the alkylating agent used for quaternization. Accordingly, the anion may be, for example, chloride, bromide, methyl sulfate, ethyl sulfate, methane sulfonate, ethane sulfonate, or toluene sulfonate. In addition to these quaternary ammonium compounds, the fabric softening component can also be a condensation product of from 1 to 3 moles of fatty acid alkyl ester or from ⅓ to 1 mole of fatty acid triglyceride with 1 mole of a hydroxyalkyl polyamine, for example hydroxyethyl ethylene diamine or hydroxyethyl diethylene triamine. The product obtainable by reaction of 1 mole of a fatty acid triglyceride, particularly hardened tallow, with 1 mole of hydroxyethyl ethylene diamine at 90° to 150° C. is particularly suitable. A quaternary ammonium compound of the ammonia type containing two $C_{16}$–$C_{20}$ alkyl or alkenyl groups and two methyl groups in the molecule and the chloride, bromide or methyl sulfate anion, more particularly distearyl dimethylammonium chloride or ditallow alkyldimethylammonium chloride, is preferably used as the fabric softener. These active constituents leave the treated textiles with a significant and uniform improvement in feel and with an antistatic finish free from any patchiness.

Laundry which has been treated with a hypochlorite-based bleach is frequently accompanied by a faint chlorine odor. To eliminate this chlorine odor, the preparation according to the invention preferably contains hydrogen peroxide ($H_2O_2$) as its antichlorinating component. The $H_2O_2$ acts as a reducing agent on the relatively strong oxidizing agent, hypochlorite. Instead of $H_2O_2$, it is also possible to use organic percarboxylic acids, such as for example diperazelaic acid or diperisophthalic acid.

It is preferred to use hydrogen peroxide by virtue of its ready availablity and because it is converted during reduction to water. Another advantage of $H_2O_2$ is that it does not form any solid deposits.

For stabilization against heavy metal ions, particularly copper and/or iron ions, the preparation according to the invention contains a heavy metal complexing agent. Suitable complexing agents are, for example, alkane polyphosphonic acids, amino alkane and hydroxyalkane polyphosphonic acids and phosphonocarboxylic acids such as, for example, the compounds methane diphosphonic acid, 1-amino-ethane-1,1-diphosphonic acid, aminotrimethylene triphosphonic acid, 2-phosphonobutane-1,2,4-tricarboxylic acid and 1-hydroxyethane-1,1-diphosphonic acid, or aminopolycarboxylic acids such as, for example, nitrilotriacetic acid, ethylene diamine tetraacetic acid or hydroxyethyl ethylene diamine triacetic acid or alkali metal salts thereof. Heavy metal complexing agents such as these also counteract any tendency of the laundry towards yellowing attributable to heavy metal ions in the rinsing water. 1-Hydroxyethane-1,1-diphosphonic acid and alkali metal salts thereof have a particularly good stabilizing effect.

If other acidic components are used in addition to the hexafluorosalicic acid and/or its water-soluble salts, they can be selected from inorganic and/or organic acids and corresponding acidic salts. It is preferred, where hydrogen peroxide is used, to select additional acids or acidic salts which do not interact with the peroxide. Orthophosphoric acid and/or acidic salts thereof, for example sodium dihydrogen phosphate, are particularly suitable.

The preparations of the invention can contain other standard additives, such as antimicrobial agents for example. Antimicrobial agents are understood to be bactericidal or bacteriostatic and fungicidal or fungistatic compounds. These additives should be water-soluble either as such or in the form of their salts. The antimicrobial agents suitable as additives are, for example, quaternary ammonium compounds which, in addition to one long-chain aliphatic and two short-chain aliphatic hydrocarbon radicals, contain in the molecule an aromatic organic radical attached to the nitrogen atom by an aliphatic carbon atom or an aliphatic organic radical containing double bonds. Examples of antimicrobial quaternary ammonium compounds of this type are dimethylbenzyl dodecylammonium chloride, dimethylbenzyl tetradecylammonium chloride, dimethyl(ethylbenzyl)-dodecylammonium chloride, dimethylbenzyldecylammonium bromide, diethylbenzyldodecylammonium chloride, diethylbenzyloctylammonium chloride, dibutylallyl-, methylethylbenzyl-, ethylcyclohexylallyl-, ethylcrotyl diethylaminoethyl dodecylammonium chloride and, in particular, cocosalkyl dimethylbenzylammonium chloride. Dimethyldidecylammonium chloride is also effective.

In addition, it is possible to use other antimicrobial agents provided they are stable in acidic medium in the presence of per compounds. Other suitable antimicrobial agents are, for example, betaines such as, for example, dodecyl di-(aminoethyl)glycine. Other suitable antimicrobial agents are, for example, hexamethylene bis-(chlorophenyl)-biguanide digluconate or dihydrochloride and dodecyl glycine.

Dispersants suitable for use in the liquid aftertreatement preparations of the invention are, in particular, nonionic surfactants ("nonionics"). These include products which owe their hydrophilic properties to the presence of polyether chains, amine oxide, sulfoxide or phosphine oxide groups, alkylol amide groups or, quite generally, to an accumulation of hydroxyl groups. Nonionics of the type in question contain in the molecule at least one hydrophobic radical containing from 8 to 26, preferably from 10 to 20 and, more preferably, from 12 to 18 carbon atoms and at least one nonionic, water-solubilizing group. The preferably saturated hydrophobic radical is generally either aliphatic or alicyclic in character. It can be attached to the water-solubilizing groups either directly or by intermediate members such as, for example, benzene rings, carboxylic acid ester or carbonamide groups, residues of polyhydric alcohols bound in ether-like or ester-like form, such as for example those of ethylene glycol, propylene glycol, glycerol or corresponding polyether residues. Typical nonionics preferred as dispersants are, for example, the adducts of approximately 9 moles of ethylene oxide with nonyl phenol or with dodecyl alcohol, polyethylene glycols containing up to 50 ethoxy units or polyethoxy- polypropoxy glycols containing up to 20 ethoxy or propoxy units.

The respective contents of the components essential to the invention in the preparations according to the invention lie within the following ranges, depending on the purpose for which they are principally intended, i.e. depending on whether the preparations are intended to show particularly pronounced fabric-softening or acidifying or antichlorinating (32 hypochlorite-reducing) properties or particularly pronounced combinations of these properties:

(a) from 1 to 25% by weight of hydrogen peroxide or an organic percarboxylic acid,
(b) from 0.1 to 10% by weight of at least one stabilizer,
(c) from 1 to 25% by weight of hexafluorosilicic acid and/or a water-soluble salt thereof,
(d) from 1 to 20% by weight of at least one fabric-softening quaternary ammonium compound,
(e) from 25 to 90% by weight of water,
(f) from 0 to 25% by weight of at least one acidic compound,
(g) from 0 to 15% by weight of at least one antimicrobial agent, and, optionally, small quantities of dispersants, foam regulators or other standard additives.

The preparations of the invention preferably have the following composition:

(a) from 1 to 15% by weight of hydrogen peroxide,
(b) from 0.2 to 3% by weight of at least one heavy metal complexing agent as a stabilizer,
(c) from 5 to 20% by weight of hexafluorosilicic acid and/or a water-soluble salt thereof,
(d) from 2 to 7% by weight of at least one fabric-softening quaternary ammonium compound,
(e) from 0.5 to 7% by weight of at least one antibacterial agent,
(f) from 40 to 85% by weight of water, and, optionally, dispersants in small quantities.

Preparations according to the invention preferably contain small quantities, for example from 0.5 to 5% by weight, of nonionic surfactants as dispersant, particularly in instances where relatively large quantities of fabric-softening quaternary ammonium compounds are used to obtain a pronounced softening effect.

The present invention also relates to a process for softening, removing active chlorine and neutralizing alkaline detergent residues and, optionally, for the antibacterial finishing of freshly washed laundry. The process of the invention is characterized in that, in the final rinse, the laundry is treated for 0.5 to 5 minutes at about 10° to 30° C. with from 0.5 to 20 g per liter of a preparation having the above-described composition which is added to the rinsing water, the laundry being kept in motion throughout the treatment. The treatment liquor is then removed, for example by squeezing out or centrifuging, to a residual moisture content of from about 10 to about 100% by weight, based on the dry weight of the laundry. The laundry is then dried, for example in a dryer. After drying, the laundry has a soft feel, being free from alkaline detergent residues. There is no perceptible chlorine odor. In addition, the acidic aftertreatment reduces incrustation, as reflected in the reduction of ash-forming constituents adhering to the fibers. In addition, the laundry thus treated shows pronounced antibacterial properties.

The invention will be illustrated, but not limited, by the following examples. EXAMPLES The following components were mixed together in a vessel using an intensive mixer:

(a) 3.75% by weight of dimethyl distearylammonium chloride,
(b) 3% by weight of hydrogen peroxide (used as a 35% by weight aqueous solution),
(c) 15% by weight of orthophosphoric acid,
(d) 0.6% by weight of 1-hydroxyethane-1,1-diphosphonic acid remainder water This mixture, which corresponds to the teaching of German Application No. P 32 05 317.7, is compared in its hydrogen peroxide retention level after storage for 12 weeks at 40° C. with the mixtures according to the invention identified by numbers 2 to 5 in the following Table. In their case, the phosphoric acid is replaced by magnesium hexafluorosilicate as acidifying agent. The superior effect of the mixtures of the invention with respect to the $H_2O_2$ retention level after storage for 12 weeks at 40° C. is apparent from the corresponding figures. The figures for mixtures 2, 4, 5 and 6 show an $H_2O_2$ retention of from 79 to 88% as opposed to 28.5% for the state-of-the-art mixture. Even the comparison mixture 3, which contains magnesium fluorosilicate, but no complexing agent, is distinctly better in its $H_2O_2$ retention level than the state-of-the-art mixture used for comparison.

TABLE

| | Dimethyl distearyl-ammonium chloride % | $H_2O_2$ % | $H_3PO4$ % | 1-hydroxyethane-1,1-diphosphonic acid % | MgSiF6 % | Antibactericidal additive(*) % | $H_2O_2$ retention level after 12 weeks at 40° C. % |
|---|---|---|---|---|---|---|---|
| State-of-the-art-mixture | 3.75 | 3 | 15 | 0.6 | — | — | 28.5 |
| 2 | 3.75 | 3 | — | 0.6 | 15 | — | 83 |
| 3 | 3.75 | 3 | — | — | 15 | — | 39 |

TABLE-continued

| | Dimethyl distearyl-ammonium chloride % | $H_2O_2$ % | $H_3PO4$ % | 1-hydroxyethane-1,1-diphosphonic acid % | MgSiF6 % | Antibactericidal additive(*) % | $H_2O_2$ retention level after 12 weeks at 40° C. % |
|---|---|---|---|---|---|---|---|
| 4 | 10 | 3 | — | 0.6 | 15 | — | 79 |
| 5 | 3.75 | 3 | — | 0.6 | 10 | — | 87 |
| 6 | 3.75 | 3 | — | 0.6 | 15 | 5 | 88 |

(*)Benzyl dimethyl cocosalkylammonium chloride

The compositions of the invention are generally added to the final rinse water of a commercial washing machine in a quantity of, preferably, from 1 to 5 g/l of rinsing water (temperature approx. 25° C.), depending on how the preceding washing process has been carried out, i.e. on the remaining alkali content or on the desired conditioning or microbicidal effect, and the washed and hypochlorite-bleached laundry is treated for about 2 minutes with the resulting treatment liquor. After treatment liquor has been removed by spinning, it can be shown by measuring the pH of the adhering moisture that alkaline detergent residues on the laundry have been neutralized. The laundry does not have any chlorine odor. After drying, it has a full soft feel.

What is claimed is:

1. In a liquid composition for aftertreating washed laundry having fabric softening, acidifying and anti-chlorinating properties and containing, in acidified aqueous solution, hydrogen peroxide or an organic percarboxylic acid, a stabilizer for peroxide compounds, a fabric-softening quaternary ammonium compound, and an acidifying agent, the improvement wherein at least a portion of said acid acidifying agent is selected from hexafluorosilicic acid a water-soluble salt thereof.

2. A composition in accordance with claim 1 wherein said hexafluorosilicic acid and a water-soluble salt thereof is present in from about 1 to about 25% by weight, based on the weight of the composition.

3. A composition in accordance with claim 2 wherein said hexafluorosilicic acid and a water soluble salt thereof is present in from about 5 to about 20% by weight.

4. A composition in accordance with claim 1 wherein a water-soluble salt of hexafluorosilicic acid is present and is a salt with a metal selected from the first to the third group of the periodic table, the ammonium salt, an amine salt, or a quaternary ammonium salt.

5. A composition in accordance with claim 4 wherein the salt is selected from the magnesium salt and the zinc salt.

6. A composition in accordance with claim 1 wherein at least one inorganic or organic acid, or an acidic salt of such acid is present as part of the acidifying agent in addition to hexafluorosilicic acid and a water-soluble salt thereof.

7. A liquid composition for aftertreating washed laundry comprising:

A. from about 1 to about 25% by weight of hydrogen peroxide or an organic percarboxylic acid.

B. from about 0.1 to about 10% by weight of at least one stabilizer,

C. from about 1 to about 25% by weight of an acidifying agent selected from hexafluorosilicic acid and a water-soluble salt thereof, D. from about 1 to about 20% by weight of at least one fabric-softening quaternary ammonium compound.

E. from about 25 to about 90% by weight of water,

F. from 0 to about 25% by weight of at least one other acidic compound, and

G. from 0 to about 15% by weight of at least one anti-microbial agent.

8. A composition in accordance with claim 7 wherein component D is dimethyl ditallow alkylammonium chloride or dimethyl distearylammonium chloride.

9. A composition in accordance with claim 7 wherein component G is a benzyl dimethyl alkylammonium chloride.

10. A composition in accordance with claim 7 wherein component B is selected from an alkane polyphosphonic acid and an aminopolycarboxylic acid.

11. A composition in accordance with claim 7 wherein the composition also contains a small quantity of a nonionic surfactant as a dispersant.

12. A composition in accordance with claim 7 wherein the composition comprises:

A. from about 1 to about 15% by weight of hydrogen peroxide,

B. from about 0.2 to about 3% by weight of at least one heavy metal complexing agent as a stabilizer, C. from about 5 to about 20% by weight of an acidifying agent selected from hexafluorosilicic acid and a water-soluble salt thereof, D. from about 2 to about 7% by weight of at least one fabric-softening quaternary ammonium compound, E. from about 40 to about 85% by weight of water, and F. from about 0.5 to about 7% by weight of at least one antibacterial agent.

13. A process for softening textiles, neutralizing alkaline detergent residues, and removing active chlorine from freshly washed laundry, comprising the steps of I. treating the washed laundry for a period of time of from about 0.5 to about 5 minutes with an aqueous solution of from about 0.5 to about 20 g/l of the composition of claim 1 while agitating the laundry, II. removing said aqueous solution from contact with the laundry until a residual solution content of from about 10 to about 100% by weight, based on the dry weight of the laundry, is obtained, and III. drying the laundry.

14. A process in accordance with claim 13 wherein the composition of claim 7 is employed in step I of the process.

15. A process in accordance with claim 13 wherein the composition of claim 12 is employed in step I of the process.

16. A composition in accordance with claim 1 wherein said composition has a pH of 4 or less.

17. A composition in accordance with claim 7 wherein said composition has a pH of 4 or less.

18. A composition in accordance with claim 7 wherein said component C is selected from the magnesium salt and the zinc salt of said hexafluorosilicic acid.

19. A composition in accordance with claim 12 wherein said component C is selected from the magnesium salt and the zinc salt of said hexafluorosilicic acid.

20. A composition in accordance with claim 1 wherein said component F is selected from orthophosphoric acid and acidic salts thereof.

* * * * *